US010184668B2

(12) United States Patent
Sanquist

(10) Patent No.: US 10,184,668 B2
(45) Date of Patent: Jan. 22, 2019

(54) STOVE TOP COVER AND SERVING TRAY

(71) Applicant: Steve Sanquist, Lancaster, CA (US)

(72) Inventor: Steve Sanquist, Lancaster, CA (US)

( * ) Notice: Subject to any disclaimer, the term of this patent is extended or adjusted under 35 U.S.C. 154(b) by 16 days.

(21) Appl. No.: 15/041,093

(22) Filed: Feb. 11, 2016

(65) Prior Publication Data

US 2016/0305669 A1 Oct. 20, 2016

Related U.S. Application Data

(60) Provisional application No. 62/147,916, filed on Apr. 15, 2015.

(51) Int. Cl.
*F24C 15/12* (2006.01)
*A47G 23/06* (2006.01)

(52) U.S. Cl.
CPC ..... *F24C 15/12* (2013.01); *A47G 23/06* (2013.01)

(58) Field of Classification Search
CPC ..... A47G 23/06; F24C 15/12
USPC ..... 126/211, 221
See application file for complete search history.

(56) References Cited

U.S. PATENT DOCUMENTS 5,323,759 A * 6/1994 Hammel ..... F24C 3/085 126/214 A
5,331,945 A 7/1994 Somerton
6,263,869 B1 7/2001 Abernethy
8,353,282 B1 1/2013 Fischer
8,668,949 B2 * 3/2014 Wilson ..... A47J 33/00 126/9 B
2009/0301462 A1 * 12/2009 Churchill ..... F24C 15/12 126/220
2013/0081608 A1 4/2013 Bonadio
2014/0190521 A1 7/2014 Fowler

* cited by examiner

*Primary Examiner* — Avinash Savani
*Assistant Examiner* — Aaron Heyamoto
(74) *Attorney, Agent, or Firm* — Global Intellectual Property Agency, LLC; Daniel Boudwin

(57) ABSTRACT

A combination stove top cover and serving tray is provided. The device comprises a cover body having a planar surface that is adapted to cover the upper surface of a stove top, thereby providing a flat, clean surface upon which to place other items, or to otherwise shroud the burners of the stove top. Around the perimeter of the planar surface is a raised wall extending substantially perpendicularly upward therefrom. The raised wall has an upper edge terminating in a common plane that is offset from the planar surface. The upper edge includes a gasket affixed therearound, which comprises a non-marring material such as rubber, plastic, or similar elastomeric material. Handles are provided along opposing raised walls of the device, while the underside of the planar surface provides a recessed, flat surface. When not covering a stove top, the device may be inverted and function as a serving tray.

2 Claims, 3 Drawing Sheets

STOVE TOP COVER AND SERVING TRAY

CROSS REFERENCE TO RELATED APPLICATION

This application claims the benefit of U.S. Provisional Application No. 62/147,916 filed on Apr. 15, 2015. The above identified patent application is herein incorporated by reference in its entirety to provide continuity of disclosure.

BACKGROUND OF THE INVENTION

Field of the Invention

The present invention relates to appliance covers and kitchen accessories. More specifically, the present invention relates to a combination device that serves as a decorative cover for a stove top surface, and doubles as a serving tray when not in use as a cover. When serving as a cover, the device secures over the upper surface of a stove top and covers the burners, providing a clean, planar surface thereover.

This invention relates to improvements in stovetop covers and general kitchen accessories. During meal preparation, kitchen stoves can become spotted with spills and splatters associated with food preparation. The stove top surface, the burners thereon, and the grates of gas-fired or electric ranges come into contact with food and other food preparation contents. These items may be difficult or bothersome to clean after each meal, and may require removal of parts to adequately access areas that need to be cleaned. Consequently, it is common for some to postpone complete cleaning of a stove top until after several uses. In the meantime, the stove top remains soiled and unattractive.

In addition to cleanliness, stoves and ovens are generally mounted in or adjacent to neighboring counter space. In smaller spaces, this consumed space may leave little room for open counter space, which is desired for food preparation and storage. As a result, a need exists for a device that can be placed over a stovetop, thereby shrouding the stove top surface from view and providing a flat surface upon which items can be placed for added counter space. The present invention contemplates such a device.

In particular, the present invention provides a combination device that offers the ability to function as a stove top cover, while also doubling as a serving tray when not deployed as a cover. The cover device comprises a planar surface, a raised perimeter wall, and a gasket along the wall upper edge. The gasket contacts the upper surface of the stove top when the cover is placed over and against the stove top surface. Handles are provided along opposing walls of the cover, whereby the device can be easily handled. When not covering a stove top surface, the cover can be inverted, and the recessed, underside of the planar surface can function as a serving tray. The user can grip the handles and serve food or place other items on the device as desired.

SUMMARY OF THE INVENTION

The following summary is intended solely for the benefit of the reader and is not intended to be limiting in any way. The present invention provides a new combination cover and tray device that can be utilized for providing convenience for the user when covering a stove top or serving food items on a tray.

It is therefore an object of the present invention to provide a new and improved combination cover and tray device that has all of the advantages of the prior art and none of the disadvantages.

It is another object of the present invention to provide a combination cover and tray device that comprises a cover body, a raised wall, and an upper edge extending around the upper periphery of the raised wall. The upper edge of the raised wall is placed against a stove top surface, whereby the planar surface functions as a cover over the stove top. The cover is sized for specific stove top surfaces, and covers the majority (or portions) thereof, as provided by the specific design and desire of the user.

Another object of the present invention is to provide a combination cover and tray device that has a raised wall having a height adapted to provide clearance for a stove top burner when the cover body is placed thereover and the upper edge is placed against a stove top surface. The cover body may be sized to cover a single burner, or alternative the entire stove top surface (e.g., over two or more burners).

Another object of the present invention is to provide a combination cover and tray device whereby the planar surface of the cover body is substantially rectangular and has a perimeter from which the raised wall extends therefrom.

Another object of the present invention is to provide a combination cover and tray device in which the raised wall extends substantially perpendicularly outward from the planar surface along its perimeter.

Another object of the present invention is to provide a combination cover and tray device that further comprises a gasket affixed around the upper edge of the raised wall. The gasket comprises a rubber, plastic, or similar elastomeric, non-marring material that is adapted to contact the stove top surface between the stove top surface and the upper edge of the cover body.

Another object of the present invention is to provide a combination cover and tray device, whereby the cover body is sized to extend over four adjacent stove top burners along a stove top surface.

Another object of the present invention is to provide a combination cover and tray device that further comprises handles extending outward from at least two of the raised walls of the cover body, such that the handles are disposed opposite of one another across the cover body.

Another object of the present invention is to provide a combination cover and tray device, in which the extendable handles are movable between a stowed state against an adjacent raised wall and a deployed state extending from the adjacent raised wall. Each of the extendable handles is preferably U-shaped, comprising a handle grip that is substantially parallel to the adjacent raised wall and a pair of handle arms that are substantially perpendicular to the raised wall.

Another object of the present invention is to provide a combination cover and tray device, whereby the pair of handle arms of each handle extend into the adjacent raised wall when in the stowed state and extend therefrom in the deployed state.

Another object of the present invention is to provide a combination cover and tray device, further comprising an enclosure disposed within the adjacent raised wall of each extendable handle. For each extendable handle, the enclosure sized to receive the pair of handle arms extending into the adjacent raised wall.

Another object of the present invention is to provide a combination cover and tray device, wherein the cover body can be inverted and used as a serving tray.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
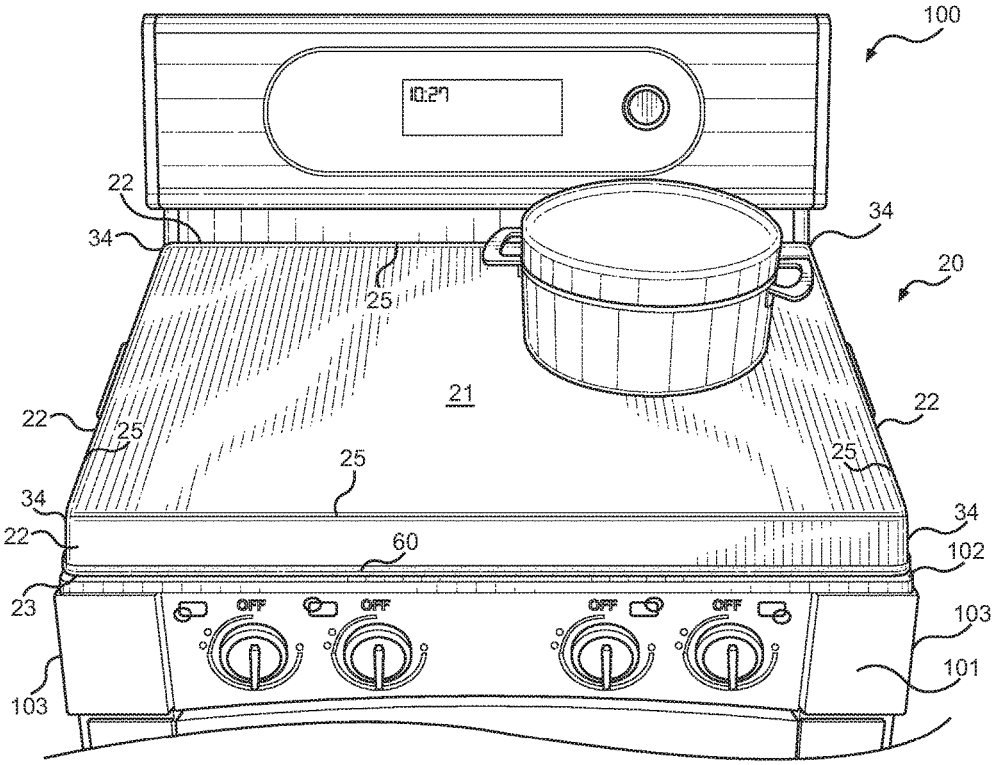
FIG. 1 shows the combination cover and tray device of the present invention in a working state, disposed over a stove top surface.

Reference is made herein to the attached drawings. Like reference numerals are used throughout the drawings to depict like or similar elements of the combination cover and tray device of the present invention. For the purposes of presenting a brief and clear description of the present invention, the preferred embodiment will be discussed as used for covering a stove top surface and functioning as a serving tray when inverted. The figures are intended for representative purposes only and should not be considered to be limiting in any respect.

Referring now to FIGS. 1-4, there is shown an overhead perspective view of the combination cover and tray device 20 in a working state. In a working state, the combination cover and tray device 20 is positioned over a stove top surface 100, shrouding one or more burners along the stove top surface 100 and providing a planar surface 21 that is more aesthetically pleasing, and one that can support other items positioned thereover. Overall, the present invention provides a stove top cover, as well as a device that can be removed from the stove top and used as a serving tray for the user. In this way, the present invention provides a dual purpose, combination device for kitchen use.

In particular, the combination cover and tray device 20 of the present invention comprises a cover body having a planar surface 21, a raised wall 22 extending around the planar surface 21, and an upper edge 23 extending around the upper extent of the raised wall 22. In one embodiment, the planar surface 21 is substantially rectangular, and the raised walls form an open interior that is sized to receive one or more burners extending from the upper surface of the stove top 100. The planar surface 21 has a perimeter 25, from which the raised wall 22 extends therefrom. The raised wall 22 extends around the entire perimeter 25 of the planar surface 21, and forms corners 34 at any discontinuity in the perimeter. In this way, the raised wall 22 may extend from a rectangular, rounded, or alternatively shaped planar surface 21, as designed and as desired by the user.

The raised wall 22 extends substantially perpendicularly from the perimeter 25 of the planar surface 21, and is adapted to be placed against the stove top surface 100. To prevent scratching or marring of the stove top surface, the upper edge 23 of the raised wall 22 further comprises a gasket 60 thereon. The gasket 60 is a rubber, plastic, or similar elastomeric, non-marring material that prevents the upper edge 23 from damaging the stove top surface 100.

Figure 3:
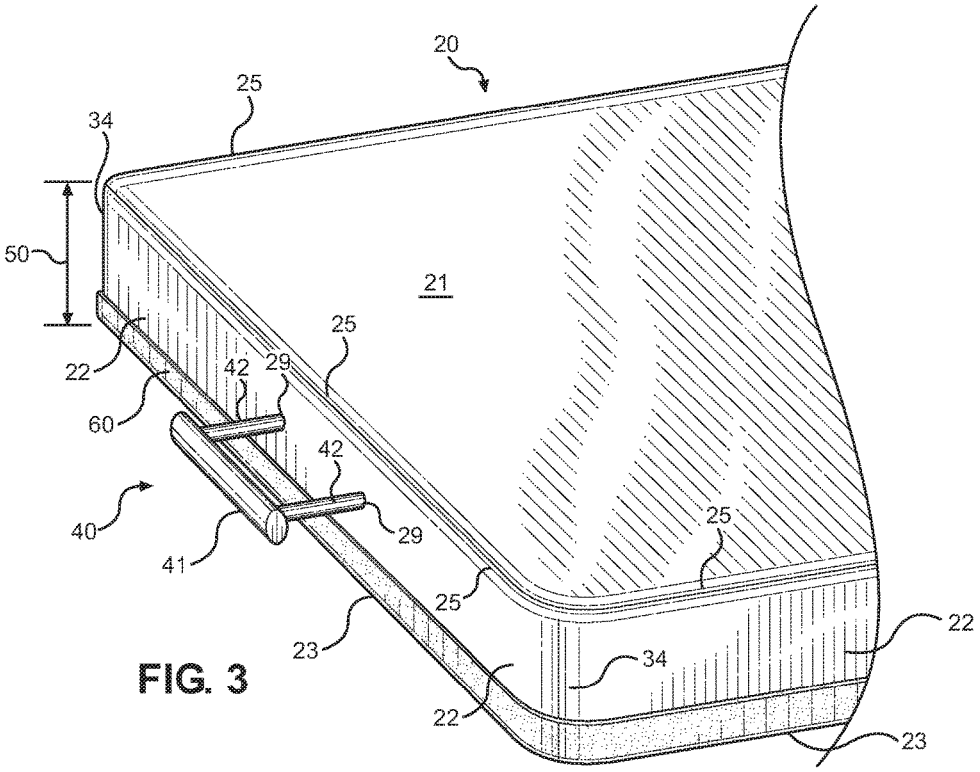
FIG. 3 shows another view of the combination cover and tray device of the present invention.

When inverted and placed onto the stove top surface 100, the upper edge 23 of the raised wall 22 terminates in a single plane that is offset from the planar surface 21. The offset between the upper edge 23 and the planar surface 21 forms the height 50 of the raised wall, as shown in FIG. 3. The height 50 of the raised wall 22 is such that the planar surface 21 is disposed above any stove top burners extending from the stove top surface as the gasket 60 and upper edge 23 are in contact with the stove top surface 100. Therefore, the height 50 of the raised wall provides adequate clearance for placement of the inverted cover body onto a stove top surface 100 that has raised burners. The exact height may vary, and be dependent upon specific burner types. The height 50 may range from a de minimus height, if flat surface (electric) burners are being cover, to several inches in height if larger; industrial (gas) burners are being covered. Several heights may be designed, falling within the scope of providing a cover body that can function as a stove top cover and a serving tray when inverted. In any of the embodiments, the raised wall 22 has a height and is present, both to offset the planar surface 21 over the stove top, as well as provide a perimeter lip around the perimeter 25 of the planar surface 21 when used as a tray.

the raised wall having a height adapted to provide clearance for stove top burners when the cover body is inverted and the gasket is placed against a stove top surface.

Figure 2:
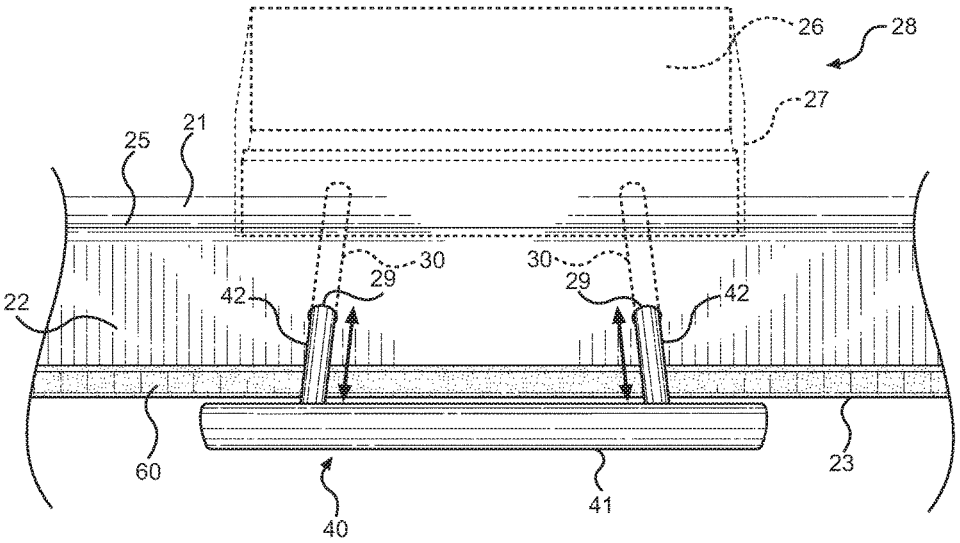
FIG. 2 shows a view of one of the cover body's raised walls, whereby the handles are extendable and shown in a deployed state.

Referring now to FIGS. 2 and 3, there are shown views of the raised wall 22 of the cover body, along with handle embodiments extending therefrom. In some embodiments, two or more raised walls 22 comprise handle 40 extending outward therefrom. The handles 40 extend outward from at least two of the raised walls 22 of the cover body such that the handles 40 are disposed opposite of one another across the cover body, thereby acting as user grips for lifting and handling the cover body. In some embodiments, the handles 40 are statically disposed in relation to the cover body. In other embodiments, the handles 40 are movable in relation thereto.

In one embodiment, and as shown in FIG. 3, the handles 40 are movable and are extendable from the raised walls 22 of the cover body. In particular, the extendable handles are movable between a stowed state against an adjacent raised wall 22, and a deployed state extending away from the adjacent raised wall 22. Each of the handles 40 may be U-shaped, comprising a handle grip 41 portion that is substantially parallel to the adjacent raised wall 22, and a pair of handle arms 42 that are substantially perpendicular to the raised wall 22. The handle arms 42 extend through apertures 29 in the raised walls 22, whereby the handle arms 42 can be slid thereinto and extended therefrom.

In some embodiments, the handle arms 42 extend into channels 30 extending through the raised walls 22. Along the interior of the raised walls 22 is an enclosure 28, which receives the handle arms 42 (and optionally the handle grip 41 as well). The enclosure 28 is a segregated, partially or completely enclosed volume within the raised wall 22 adjacent to the handle 40. The enclosure 28 has an upper and lower surface 26, as well as sidewall surfaces 27 that create either an enclosed volume, or an enlarged opening in the raised wall 22 that receives the handle 40 therein. As further illustrated in FIG. 4, the enclosure 28 may extend through the raised walls 22 and form an opening 38 along the interior of the cover body. Further still, the enclosure 28 may be formed into a raised ledge 39 that extends along opposing raised walls 22 of the cover body. These contemplated structures are utilized to receive the handles 40 therein such that the handles 40 do not extend substantially outward from the outer surfaces of the raised walls 22. The handles 40 may complete extend thereinto, or may only partially extend thereinto depending upon design.

Figure 4:
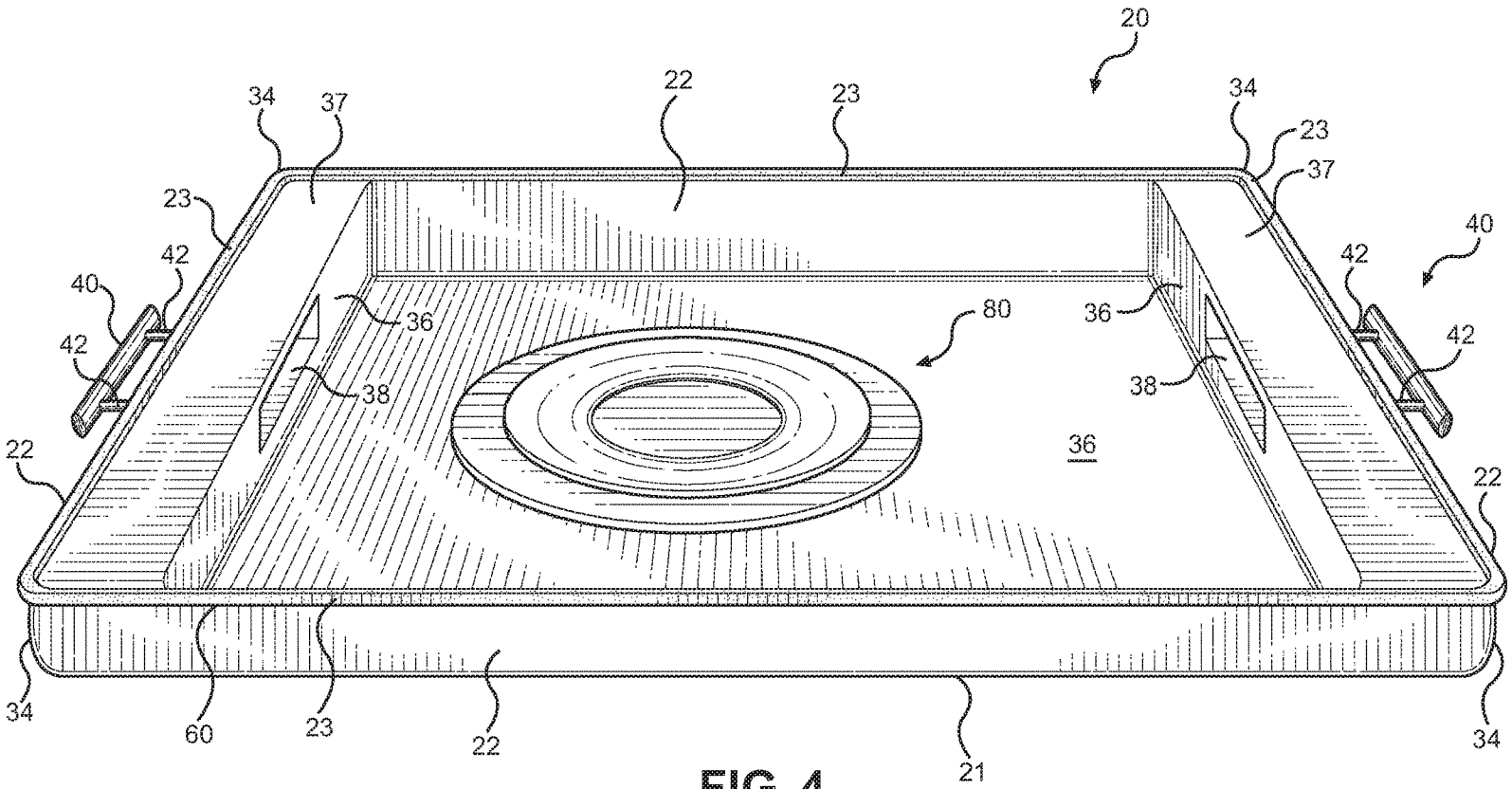
FIG. 4 shows the combination cover and tray device of the present invention in use as a serving tray.

Referring now to FIG. 4, there is shown a view of the combination stove top cover and tray device 20 in an inverted position, whereby the open interior is shown supporting items 80 thereon. The cover body in this position can be used as a serving tray, whereby the handles 40 are used to support the cover body, as the underside 36 of the planar surface 21 is used as a tray surface. The underside of the cover body comprises a recessed surface 36 that is bounded by the raised walls 22 and the enclosure ledges 36 that may be disposed along opposing walls 22.

Overall, the cover body of the present invention may be sized to extend over at least one stove top burner along a stove top surface, and may be sized to cover four adjacent stove top burners along a conventional stove top surface. The device is placed over the burners of the stove top, whereby the raised walls 22 provide clearance for the burners and the upper edge 23 of the raised walls is placed in contact with the stove top surface. The upper surface 21 of the cover body forms a smooth, clean surface over the stove top, which can be used for additional counter space, or as a cover for an otherwise soiled stove top surface. The gasket between the upper edge and the stove top prevents marring or scratching of the stove top surface, while the handles provide the user with an easy means of gripping and moving the device. When not being utilized as a stove top cover, the device can be flipped over and used as a serving tray. In this way, the device affords the user with a dual purpose kitchen accessory.

It is submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A stove top cover and serving tray device, comprising:

a cover body having a first side and a second side, wherein the first side comprises a planar surface having a raised wall extending perpendicularly from a perimeter thereof;

the raised wall having an upper edge terminating in a plane parallel and offset from the planar surface;

the upper edge of the raised wall having a gasket affixed therearound;

the raised wall configured to have a height adapted to provide clearance for a stove top burner when the cover body is inverted and the gasket is placed against a stove top surface;

the second side having a flat surface configured to support cookware thereon;

the cover body having a first end and an opposing second end;

wherein a pair of extendable handles are disposed on the raised wall at the first end and the second end, respectively;

whereby the extendable handles are movable between a stowed state against an adjacent raised wall, and a deployed state extending from the respective raised wall;

wherein each extendable handle is positioned intermediate the gasket and the perimeter, wherein a handle arm of each extendable handle is configured to slidably engage a corresponding aperture disposed on the respective raised wall;

wherein the raised wall disposed on the first end and the second end have a lateral width forming a raised ledge that extends entirely along a front end and an opposing rear end, wherein the lateral width of the raised ledge is dimensioned to receive the handle arm in the stowed state.

2. The stove top cover and serving tray device of claim 1, wherein the gasket further comprises an elastomeric material.

* * * * *